US012378048B2

(12) United States Patent
Roberts et al.

(10) Patent No.: US 12,378,048 B2
(45) Date of Patent: Aug. 5, 2025

(54) SYSTEMS AND DEVICES FOR A CONTAINER WITH A SELF-LEVELING LID

(71) Applicant: Starbucks Corporation, Seattle, WA (US)

(72) Inventors: Brandon Michael Roberts, Snohomish, WA (US); Jonathan Levey, Geneseo, NY (US); Ryan M. Gorham, Kirkland, WA (US)

(73) Assignee: Starbucks Corporation, Seattle, WA (US)

( * ) Notice: Subject to any disclaimer, the term of this patent is extended or adjusted under 35 U.S.C. 154(b) by 169 days.

(21) Appl. No.: 18/181,358

(22) Filed: Mar. 9, 2023

(65) Prior Publication Data

US 2024/0300709 A1 Sep. 12, 2024

(51) Int. Cl.

| | |
|---|---|
| ***B65D 51/18*** | (2006.01) |
| ***B65D 21/02*** | (2006.01) |
| ***B65D 43/02*** | (2006.01) |
| ***B65D 43/16*** | (2006.01) |
| ***B65D 51/24*** | (2006.01) |

(52) U.S. Cl.

CPC ..... *B65D 51/24* (2013.01); *B65D 21/0223* (2013.01); *B65D 43/02* (2013.01); *B65D 43/16* (2013.01); *B65D 2543/00231* (2013.01)

(58) Field of Classification Search

CPC .... B65D 51/24; B65D 21/0223; B65D 43/02; B65D 43/16; B65D 43/161; B65D 2543/00231; B65D 2543/00842; B65D 83/06; B44D 3/128; B44D 3/12

USPC ..... 220/695, 254.3, 259.1, 834, 835, 836

See application file for complete search history.

(56) References Cited

U.S. PATENT DOCUMENTS

| | | | | |
|---|---|---|---|---|
| D120,746 | S | 5/1940 | Trevisan | |
| D209,847 | S | 1/1968 | Taylor | |
| 3,412,809 | A | 11/1968 | Shiret | |
| 3,417,897 | A * | 12/1968 | Johnson | B65D 43/161 220/837 |
| 4,260,069 | A | 4/1981 | Juergens | |
| D276,400 | S | 11/1984 | Daenen et al. | |
| D277,724 | S | 2/1985 | Daenen et al. | |
| D283,861 | S | 5/1986 | Cantolino | |

(Continued)

FOREIGN PATENT DOCUMENTS

| | | |
|---|---|---|
| CN | 304611085 | 5/2018 |
| EM | 008713267-0002 | 10/2021 |

(Continued)

OTHER PUBLICATIONS

International Search Report and Written Opinion in application No. PCT/US2024/018016, mailed on May 14, 2024, in 13 pages.

(Continued)

*Primary Examiner* — King M Chu

(74) *Attorney, Agent, or Firm* — Knobbe, Martens, Olson & Bear, LLP

(57) ABSTRACT

A self-leveling container system may include a container and a lid. The lid may include a leveling mechanism coupled to a first portion of the lid a distance from a front edge of the first portion. The lid may include a second portion rotatably coupled to the first portion. The leveling mechanism may be configured to contact a scoop to remove excess of one or more substances in a scoop when the scoop is removed from the recess.

25 Claims, 13 Drawing Sheets

(56) References Cited

U.S. PATENT DOCUMENTS

| | | | | |
|---|---|---|---|---|
| 4,744,487 | A | 5/1988 | Welborn | |
| D336,243 | S | 6/1993 | Evans | |
| D402,509 | S | 12/1998 | Indekeu | |
| D430,779 | S | 9/2000 | Saunders | |
| 6,119,890 | A | 9/2000 | Kawamata | |
| D432,869 | S | 10/2000 | Saunders | |
| D459,144 | S | 6/2002 | Brady | |
| D462,613 | S | 9/2002 | Bried et al. | |
| 6,772,904 | B1 | 8/2004 | Gilliam et al. | |
| 6,889,866 | B2 | 5/2005 | Gilliam et al. | |
| D515,313 | S | 2/2006 | Uffner et al. | |
| D535,564 | S | 1/2007 | Toth et al. | |
| D540,174 | S | 4/2007 | Lux | |
| D590,668 | S | 4/2009 | Kim | |
| D607,315 | S | 1/2010 | George et al. | |
| D630,852 | S | 1/2011 | Kobilarcik et al. | |
| D676,238 | S | 2/2013 | Wu et al. | |
| D686,920 | S | 7/2013 | Cassius et al. | |
| D777,428 | S | 1/2017 | Hsu | |
| D784,811 | S | 4/2017 | Scevola | |
| D823,681 | S | 7/2018 | Hendricks et al. | |
| D859,977 | S | 9/2019 | Pou | |
| D879,612 | S | 3/2020 | Sarhan | |
| D888,506 | S | 6/2020 | Yang | |
| D917,980 | S | 5/2021 | Lee | |
| D992,343 | S | 7/2023 | Sciortino | |
| D993,403 | S | 7/2023 | Schweizer | |
| D1,040,624 | S | 9/2024 | Ding | |
| 2005/0042338 | A1 | 2/2005 | Tucker et al. | |
| 2005/0236465 | A1* | 10/2005 | Stevens | B65D 43/0222 229/125.05 |
| 2012/0048874 | A1* | 3/2012 | Oakes | B65D 43/162 220/834 |
| 2016/0262448 | A1 | 9/2016 | Zeitlin | |

FOREIGN PATENT DOCUMENTS

| | | | |
|---|---|---|---|
| EM | 015006177-0001 | | 9/2024 |
| EM | 015006177-0002 | | 9/2024 |
| EP | 0922650 | B1 | 11/2003 |
| FR | 2935692 | A1 | 3/2010 |
| JP | D1511168 | | 11/2014 |
| JP | D1602635 | | 4/2018 |
| JP | D1666430 | | 8/2020 |
| KR | 3008-012060000 | | 6/2015 |
| KR | 3010-363890000 | | 12/2019 |
| TW | D195503 | | 1/2019 |
| TW | D219008 | | 5/2022 |
| WO | WO 2005/108231 | A1 | 11/2005 |
| WO | WO 2016/126194 | A1 | 8/2016 |

OTHER PUBLICATIONS

Hanamya 10 Liter / 20 lbs Rice Storage Container, first available Oct. 29, 2020, retrieved from: https://www.amazon.com/HANAMYA-20-lbs-count-Clear/dp/B08M49GSLB?th=1 on Aug. 9, 2023.

LocknLock Easy Essentials Food Lids (Flip-Top) first available Jan. 10, 2022, retrieved from: https://www.amazon.com/LOCK-Storage-Container_405-77-oz-50-72-cup/dp/B00407NOC4 on Aug. 9, 2023/.

AMAC Medium Goodie Bin with Scoop Clear, retrieved from: https://www.containerstore.com/s/kitchen/good-storage-goodie-bins/12d?productid=10024362 on Aug. 9, 2023.

Clear Plastic Storage Organizer Bins, retrieved from: https://www.amazon.com/Aconfei-Plastic-Organizer-Stackable-Organization/dp/B0C8H61N5D on Apr. 22, 2024.

Premium Rice Storage Container, first available Nov. 30, 2019, retrieved from: https://www.amazon.de/-/en/Premium-Storage-Container-Moisture-Resistant-Organiser/dp/B081SJ3JCZ on Apr. 22, 2024.

Anchor Hocking Glass Penny Candy Jar with Chrome Cover, first available Aug. 3, 2007, retrieved from: https://www.amazon.com/dp/B007IG926C on Apr. 22, 2024.

Rice Storage Container 10 KG, MAJOZ0, date first available Aug. 1, 2020 (online), site visited Oct. 10, 2024, https://www.amazon.co.uk/MAJOZ0-Storage-Container-Kitchen-Measuring/dp/B08F3JPSSK (2020).

* cited by examiner

SYSTEMS AND DEVICES FOR A CONTAINER WITH A SELF-LEVELING LID

FIELD

The present disclosure relates to systems and devices for a container with a self-leveling lid, such as in certain embodiments, a self-leveling container system with a lid including a leveling mechanism.

SUMMARY

For purposes of this summary, certain aspects, advantages, and novel features are described herein. It is to be understood that not necessarily all such advantages may be achieved in accordance with any particular embodiment. Thus, for example, those skilled in the art will recognize the disclosures herein may be embodied or carried out in a manner that achieves one or more advantages taught herein without necessarily achieving other advantages as may be taught or suggested herein.

In some embodiments, a self-leveling container system can include: a container configured to contain one or more substances, the container including: a bottom; a sidewall coupled to the bottom, the sidewall including a first edge; a front wall coupled to the sidewall, the front wall including a second edge, wherein the second edge forms a first angle with the first edge; a recess, wherein the recess is formed by the bottom, the sidewall and the front wall; and an opening to the recess, the opening including a flat portion formed by the first edge, and an angled portion formed by the second edge, wherein the angled portion is positioned at a second angle relative to the flat portion, wherein the second angle is a same angle as the first angle; a lid including: a first portion including a leveling mechanism coupled to the first portion a distance from a front edge of the first portion; a second portion rotatably coupled to the front edge of the first portion, wherein when the first portion of the lid is coupled to the container, the first portion of the lid is configured to cover the flat portion of the opening, and the second portion is configured to cover the angled portion of the opening, and wherein the leveling mechanism is configured to contact a scoop to remove excess of the one or more substances in the scoop when the scoop is removed from the recess.

In some embodiments, the lid can include a gap between the front edge of the first portion and the second portion.

In some embodiments, the leveling mechanism can inhibit the one or more substances from leaving the container via the gap when the leveling mechanism contacts the scoop.

In some embodiments, the distance can be between about 2 mm and about 10 mm.

In some embodiments, the leveling mechanism can include a height between about 2 mm and about 15 mm.

In some embodiments, the leveling mechanism can include a width between about 40 mm and about 120 mm.

In some embodiments, the container can include an angled wall coupled to the bottom of the container and a bottom edge of the front wall of the container, wherein the bottom edge is opposite the second edge.

In some embodiments, the angled wall can form a third angle with the bottom of the container.

In some embodiments, the third angle can be a same angle as the first angle.

In some embodiments, the first angle can be a same angle as the second angle, and wherein the first angle and the second angle are an angle between about 30 degrees and about 60 degrees.

In some embodiments, the lid can include a closed position and an open position, and wherein the second portion is configured to rotate between the closed position and the open position.

In some embodiments, the second portion can contact the second edge when lid is in the closed position.

In some embodiments, the angled portion of the opening can extend below the leveling mechanism.

In some embodiments, a portion of the second edge of the front wall can be positioned below the leveling mechanism.

In some embodiments, when the scoop is removed from the container, the scoop can form an angle with the first portion of the lid, and wherein the leveling mechanism can be configured to contact the scoop when the scoop is removed from the container at any angle.

In some embodiments, the angled portion of the opening can extend below the leveling mechanism, and when the scoop is removed from the container, the scoop can form an angle with the first portion of the lid, and wherein the leveling mechanism can be configured to contact the scoop when the scoop is removed from the container at any angle.

In some embodiments, a portion of the second edge of the front wall can be positioned below the leveling mechanism, and when the scoop is removed from the container, the scoop can form an angle with the first portion of the lid, and wherein the leveling mechanism can be configured to contact the scoop when the scoop is removed from the container at any angle.

In some embodiments, the bottom of the container can include a stand, and the lid can include a recess.

In some embodiments, the container can be a first container and the lid can be a first lid, and the system can include a second container and a second lid, and wherein the recess of the first lid can be configured to receive a stand of the second container to secure the second container to the first lid so the second container is stacked on top of the first lid and the first container.

In some embodiments, a lid for a self-leveling container system can include: a first portion including a leveling mechanism coupled to the first portion a distance from a front edge of the first portion; a second portion rotatably coupled to the front edge of the first portion, wherein the leveling mechanism is configured to contact a scoop to remove excess substance in the scoop when the scoop is removed from a container.

In some embodiments, the lid can further include a gap between the front edge of the first portion and the second portion.

In some embodiments, the leveling mechanism can inhibit the one or more substances from leaving the container via the gap when the leveling mechanism contacts the scoop.

In some embodiments, the lid can include a closed position and an open position, and wherein the second portion is configured to rotate between the closed position and the open position.

In some embodiments, the distance can be between about 2 mm and about 10 mm.

In some embodiments, the leveling mechanism can include a height between about 2 mm and about 15 mm.

In some embodiments, the leveling mechanism can include a width between about 40 mm and about 120 mm.

In some embodiments, the leveling mechanism can be coupled to the first portion at an angle between about 45 degrees and about 90 degrees.

BRIEF DESCRIPTION OF THE DRAWINGS

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Figure 1:
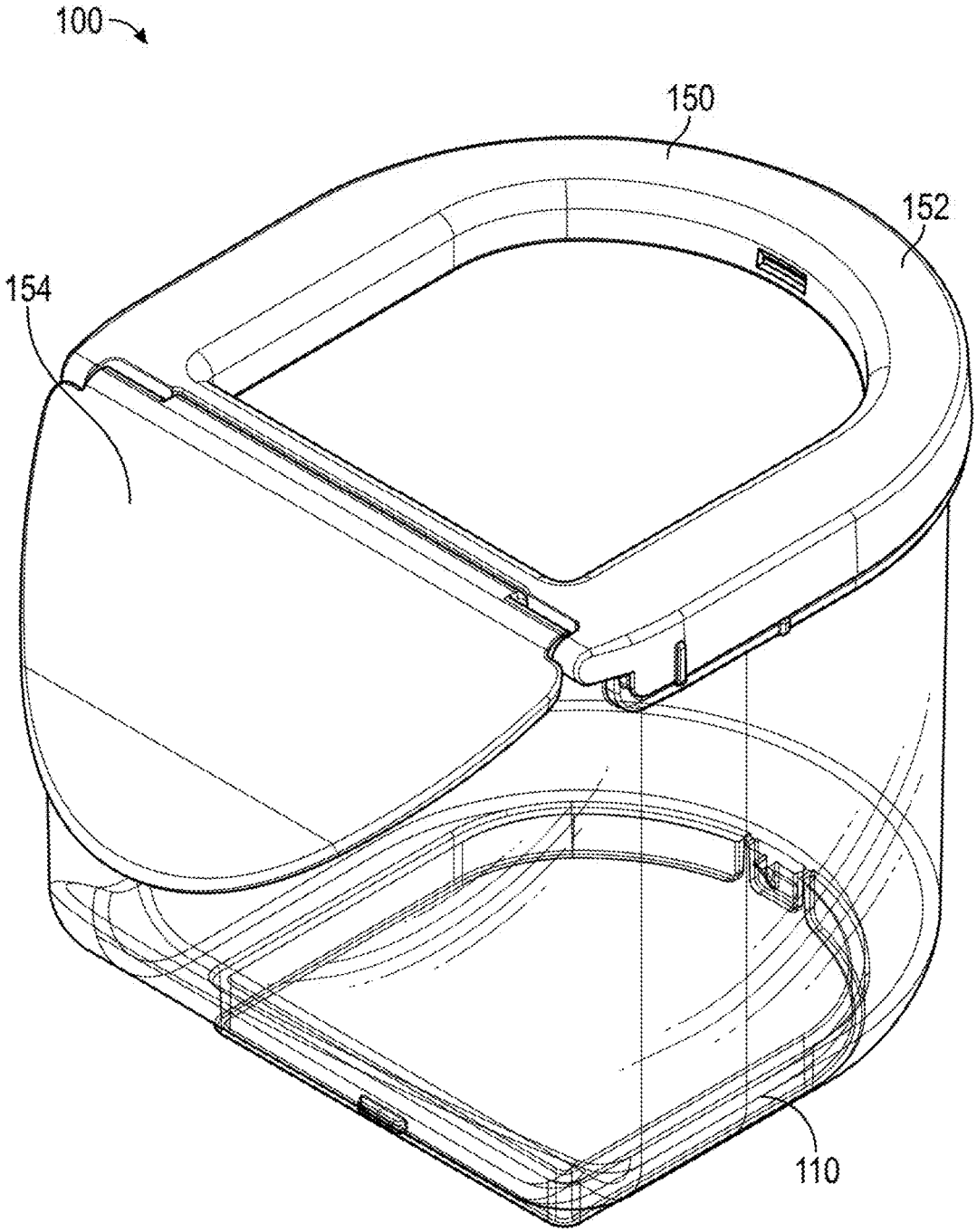
FIG. 1 illustrates an embodiment of a self-leveling container system.

Although several embodiments, examples, and illustrations are disclosed below, it will be understood by those of ordinary skill in the art that the system, methods, and devices described herein extend beyond the specifically disclosed embodiments, examples, and illustrations and includes other uses of the system, methods, and devices and obvious modifications and equivalents thereof. Embodiments of the disclosure are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing the system, methods, and devices herein described.

Beverages, particularly shaken or blended beverage usually include one or more dry ingredients or modifiers (e.g., powders) for flavor or nutrients (e.g., protein). A recipe for a beverage including one or more dry ingredients or modifiers may include a number of scoops of a dry ingredient or modifier in the beverage. A scoop used to remove the dry ingredient or modifier from a container may be configured to hold a predetermined volume of dry ingredient or modifier. The number of scoops included in the recipe for the beverage. However, when removing scoops of the dry ingredient from a container, the dry ingredient or modifier may fill the scoop such that the volume of the dry ingredient or modifier in the scoop is larger than the predetermined volume. The volume of the dry ingredient or modifier in the scoop may be different each time the dry ingredient is removed from the container with the scoop. Therefore, the beverage may include an incorrect amount of the dry ingredient or modifier and each beverage may include a different amount of the dry ingredient or modifier.

High volume beverage producers, such as a café or a coffee store, may want to reduce the variation of the volume of the dry ingredient or modifier removed from a container via a scoop. However, due to food regulations or other local rules, workers may not be able to remove excess dry ingredient or modifier from the scoop by hand. Additionally, high volume beverage produces may want an efficient way to remove excess dry ingredient or modifier from to maximize beverage throughput.

In accordance with several embodiments, the systems described herein advantageously remove excess dry ingredient or modifier form the scoop as the scoop is removed from a container. The system includes a lid with a leveling mechanism. The leveling mechanism may contact the scoop to remove the excess dry ingredient or modifier from the scoop, so the excess dry ingredient or modifier remains in the container. The leveling mechanism may be coupled to a first portion of the lid a distance from a gap between the first portion and a rotatable second portion of the lid, so the excess dry ingredient or modifier does not leave the container via the gap. In some embodiments, the leveling mechanism may contact the scoop regardless of a volume of the dry ingredient or modifier in the container. In some embodiments, the leveling mechanism may contact the scoop when a user removes the scoop from the container in a normal motion (i.e., the user does not have to move the scoop specifically to contact the leveling mechanism).

FIG. 1 shows a self-leveling container system 100. In some embodiments, the self-leveling container system 100 may include a container 110 and a lid 150.

FIGS. 2A-2D show an embodiment of the container 110 of the self-leveling container system 100. The container 110 may include sidewall 112, a front wall 114, and an angled wall 115. In some embodiments, the sidewall 112 and the angled wall 115 may be coupled to a bottom 113 of the container 110. The angled wall 115 may be coupled to a front edge 113A of a perimeter of the bottom 113. The sidewall 112 may be coupled to the rest of the perimeter the bottom 113 from a right end 113A-1 of the front edge 113A of the bottom 113 to a left end 113A-2 of the front edge 113A of the bottom 113, where left and right are designated as left and right when the container 110 is viewed from a front view shown in FIG. 2C.

In some embodiments, the front wall 114 may extend a distance 123 from the front edge 113A of the bottom 113. In some embodiments, the distance 123 may include a distance of about 5 mm, about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, and/or any value between the aforementioned values. In some embodiments, the distance 123 may include a distance between about 20 mm and 70 mm. In some embodiments, the distance 123 may include a distance between about 40 mm and about 60 mm.

The angled wall 115 may be coupled a bottom edge 114B of the front wall 114. The angled wall 115 and/or the bottom edge 114B of the front wall 114 may form an angle 120 with the bottom 113. In some embodiments, the angle 120 may be about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, and/or any value between the aforementioned values. In some embodiments, the angle 120 may be between about 30 degrees and about 60 degrees. In some embodiments, the angle 120 may be between about 40 degrees and about 50 degrees.

The sidewall 112, the front wall 114, the angled wall 115 and the bottom 113 may form a recess 116. In some embodiments, the recess 116 may be configured to hold or contain one or more substances 202, as shown in FIG. 5. In some embodiments, the one or more substances 202 may include dry substances, wet substances, beverage ingredients, dry beverage ingredients, powdered beverage ingredients, liquid beverage ingredients, and/or any other substance. The sidewall 112 and the front wall 114 may form an opening 118 opposite the bottom 113 of the container 110. In some embodiments, the one or more substances 202 may be inserted into and/or removed from the recess 116 via the opening 118.

In some embodiments, as discussed further below with reference to FIG. 5, the angled wall 115 may direct the one or more substances 202 in the recess 116 towards a portion of the recess 116 located above the bottom 113 and/or away from the front wall 114.

In some embodiments, the sidewall 112 may include a top edge 112A and the front wall 114 may include a top edge 114A. The top edge 112A of the sidewall 112 may include an edge of the sidewall 112 opposite the bottom 113. The top edge 114A of the front wall 114 may include an edge of the front wall 114 opposite the bottom edge 114B. The top edge 112A of the sidewall 112 and a top edge 114A of the front wall 114 may form the opening 118.

In some embodiments, the opening 118 may extend to the front wall 114. In some embodiments, the opening 118 may include a flat portion 118A and an angled portion 118B. The flat portion 118A may include a portion of the opening 118 formed by the top edge 112A of the sidewall 112. The flat portion 118A may include a portion of the opening 118 positioned or located above the bottom 113. The angled portion 118B may include a portion of the opening 118 formed by the top edge 114A of the front wall 114. The angled portion 118B of the opening 118 may include a portion of the opening 118 above the angled wall 115. In some embodiments, the angled portion 118B may be a portion of the opening 118 positioned or located between the front wall 114 and the front edge 113A of the bottom 113.

In some embodiments, the top edge 114A of the front wall 114 and/or the angled portion 118B of the opening 118 may form and angle 122 with the top edge 112A of the sidewall 112 and/or the flat portion 118A of the opening 118. In some embodiments, the angle 122 may be about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, and/or any value between the aforementioned values. In some embodiments, the angle 122 may be between about 30 degrees and about 60 degrees. In some embodiments, the angle 122 may be between about 40 degrees and about 50 degrees.

Figure 2A:
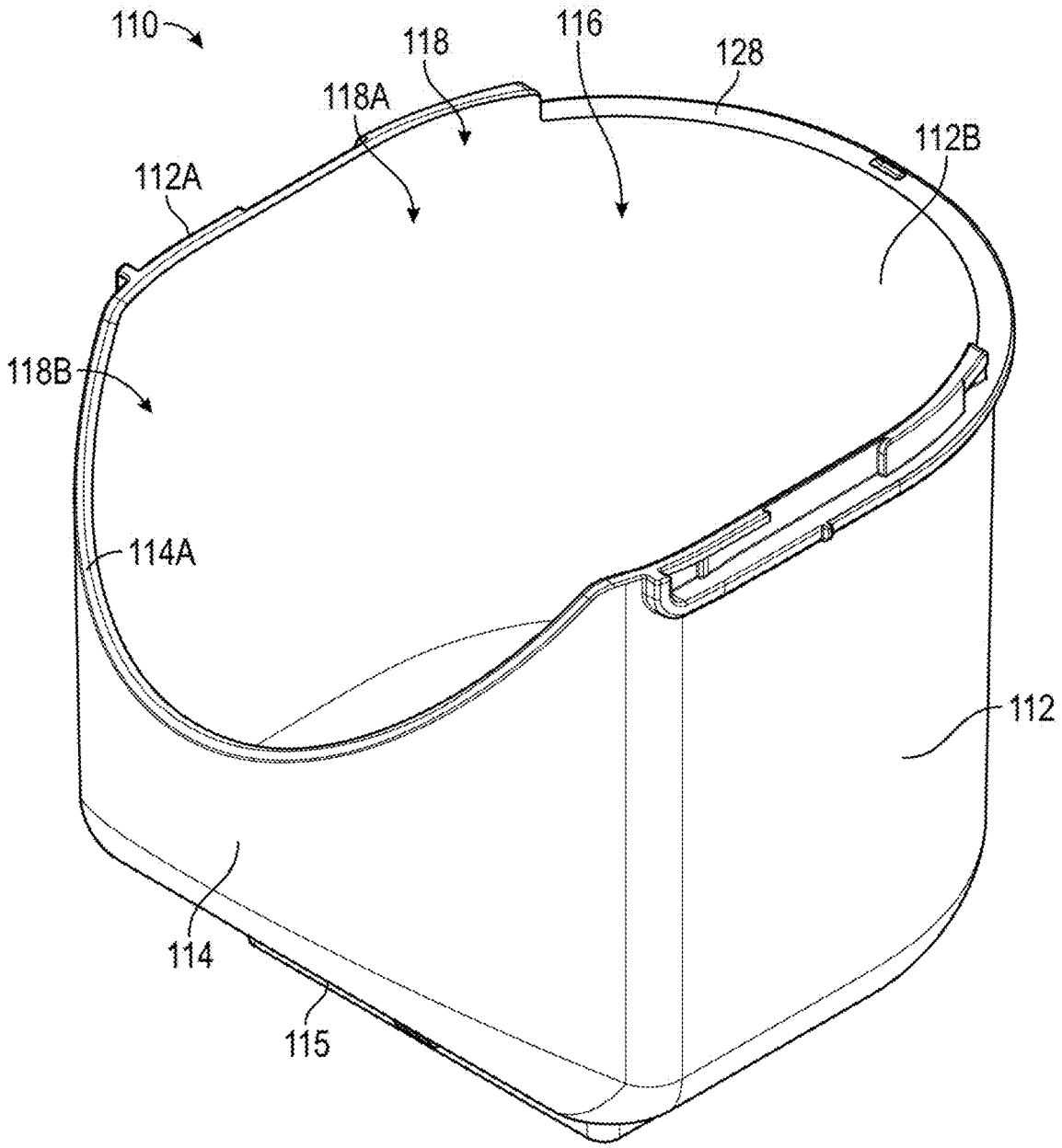
FIG. 2A illustrates a perspective view of a container of the self-leveling container system of FIG. 1.
Figure 2B:
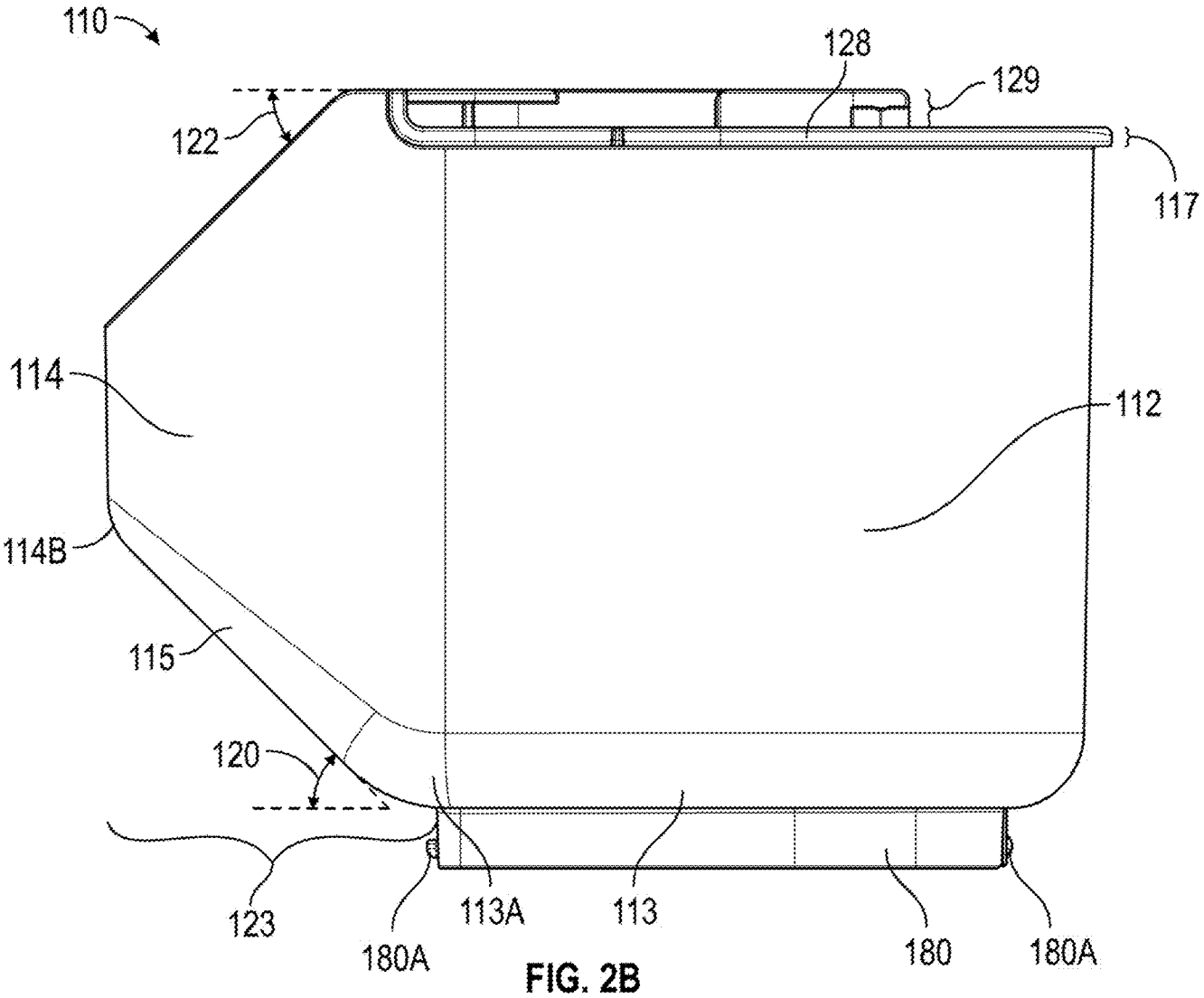
FIG. 2B illustrates a side view of the container of FIG. 2A.
Figure 2C:
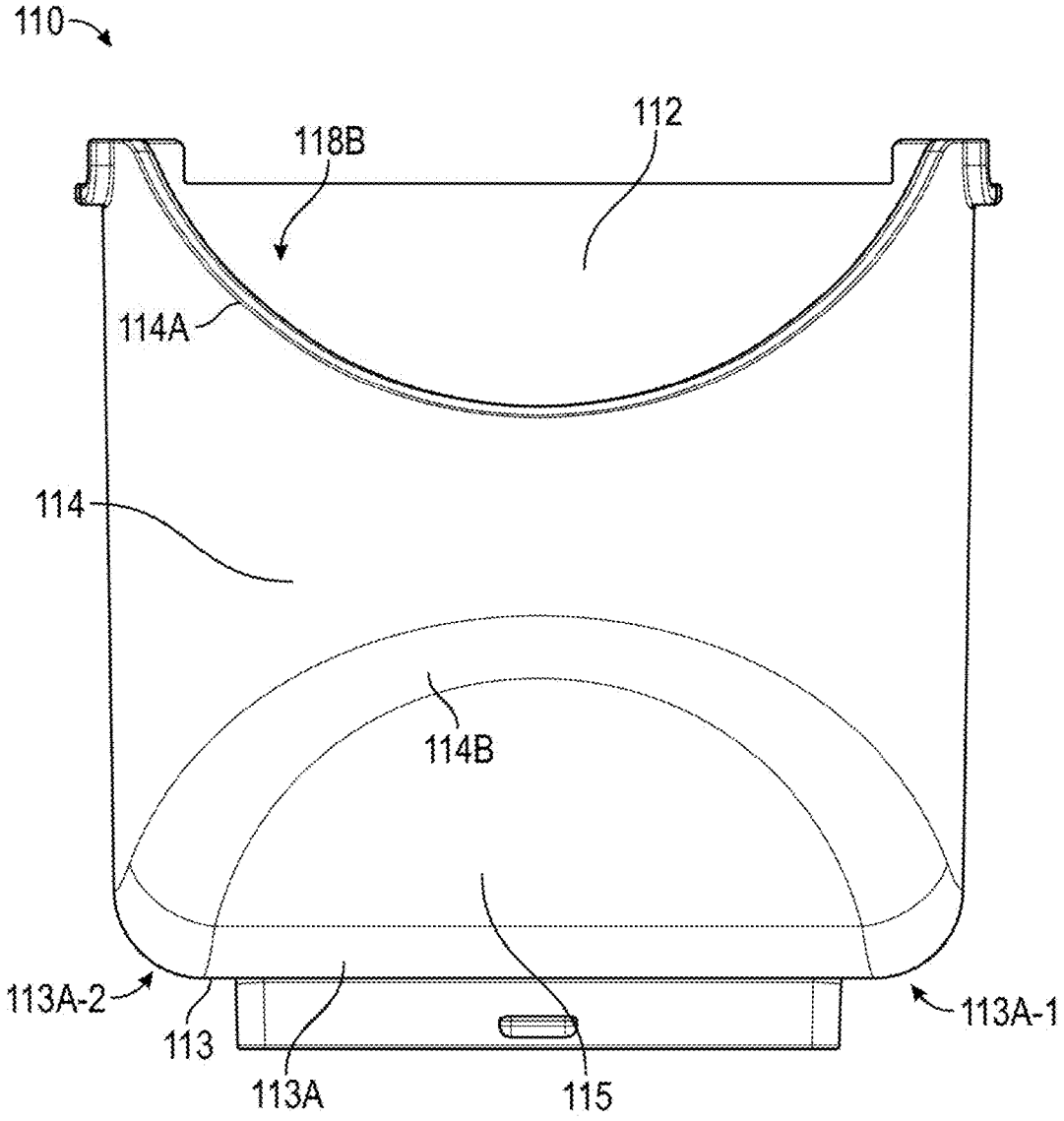
FIG. 2C illustrates a front view of the container of FIG. 2A.
Figure 2D:
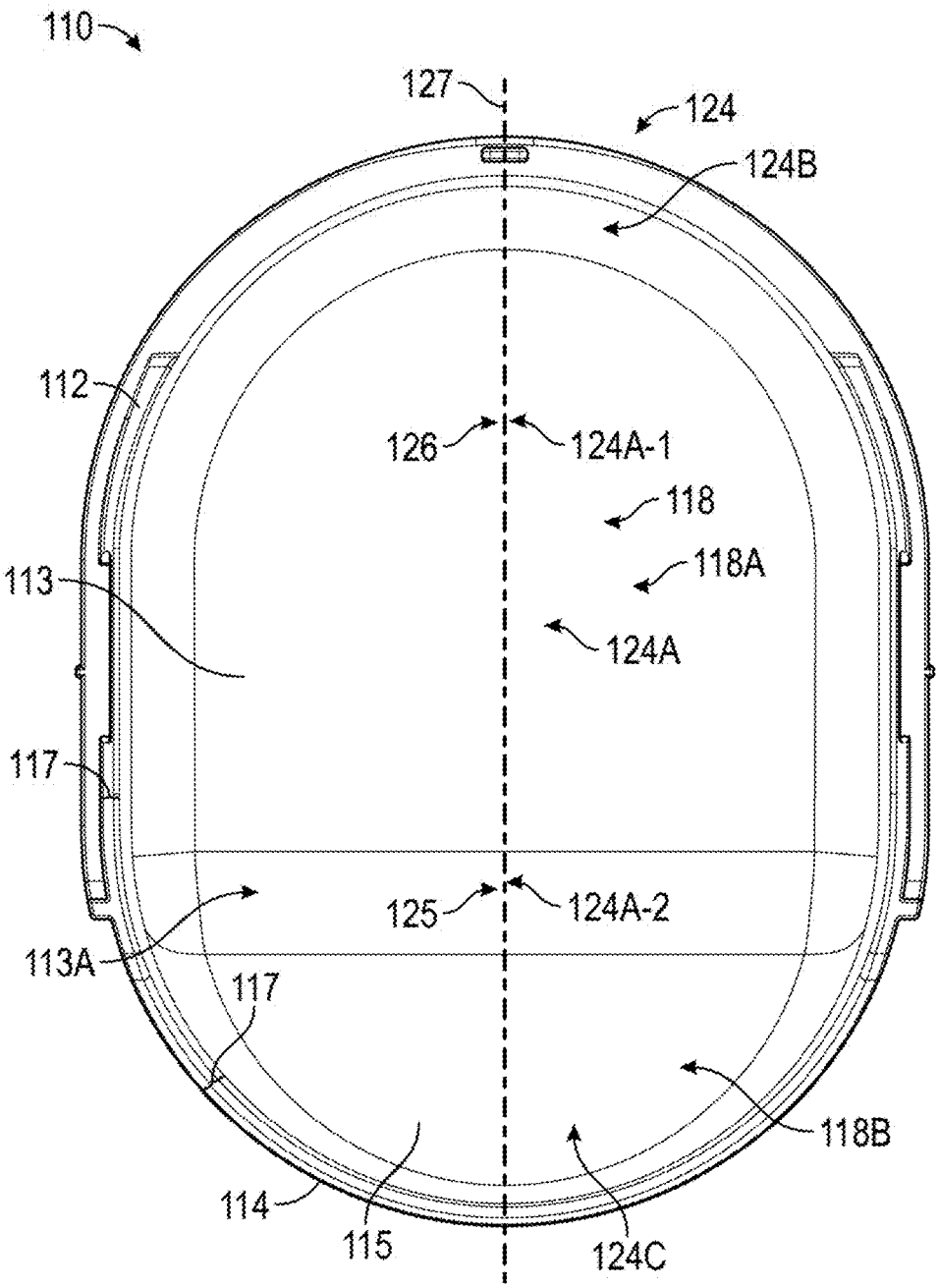
FIG. 2D illustrates a top view of the container of FIG. 2A.

As shown in FIG. 2D, in some embodiments, the container 110 may include a profile shape 124 when viewed from a top plan view. The profile shape 124 may include a circle, an ellipse, an oval, a stadium shape, a pill shape, and/or any other rounded shape. In some embodiments, the profile shape 124 may include a square shape or a rectangle shape with a semicircle at opposite ends of the square shape or rectangle shape.

In some embodiments, the bottom 113 and/or the sidewall 112 may form a portion of the profile shape 124. In some embodiments, the bottom 113 and/or the sidewall 112 may form a central portion 124A of the profile shape 124, and a first peripheral portion 124B of the profile shape 124. The central portion 124A of the profile shape may include a portion of the profile shape 124 from a position 125 along a length of an axis 127 where the front wall 114 may be coupled to the sidewall 112 (i.e., the front edge 113A of the bottom 113) to a position 126 along the length of the axis 127 where the sidewall 112 curves. The axis 127 may extend from a location on the front wall 114 the furthest distance from the front edge 113A of the bottom 113 to a location on the sidewall 112 the furthest distance from the front wall 114. The first peripheral portion 124B may include a portion of the profile shape 124 that extends from a first end 124A-1 of the central portion 124A where the first end 124A-1 is located at the position 126 along the length of the axis 127.

In some embodiments, the angled wall 115 and/or the front wall 114 may be form a second peripheral portion 124C of the profile shape 124. The second peripheral portion 124C may include a portion of the profile shape 124 that extends from a second end 124A-2 of the central portion 124A wherein the second end 124A-2 is located at the position 125 along the length of the axis 127 (i.e., the front edge 113A of the bottom 113). In some embodiments, the first end 124A-1 of the central portion 124A may be opposite the second end 124A-2 of the central portion 124A.

In some embodiments, the central portion 124A may include a square shape, a rectangle shape, a rhombus shape, a trapezoid shape, and/or any other shape. In some embodiments, the first peripheral portion 124B and/or the second peripheral portion 124C may include a semicircle shape, a semi ellipse shape, a parabolic shape, a rectangular shape, a squared shape, and/or any other shape.

In some embodiments, the opening 118 may include the profile shape 124. The flat portion 118A of the opening 118 may include the central portion 124A of the profile shape 124 and the first peripheral portion 124B of the profile shape 124. The angled portion 118B of the opening 118 may include the second peripheral portion 124C of the profile shape 124.

In some embodiments, the sidewall 112, the bottom 113, the front wall 114, and/or the angled wall 115 may include a thickness 117. In some embodiments, the thickness 117 of the sidewall 112, the bottom 113, the front wall 114, and/or the angled wall 115 may each include a same thickness. In some embodiments, the thickness 117 of one or more of the sidewall 112, the bottom 113, the front wall 114, and/or the angled wall 115 may include a different thickness. In some embodiments, the thickness 117 may include a distance of about 0.1 mm, about 0.5 mm, about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, and/or any value between the aforementioned values. In some embodiments, the thickness 117 may include a distance between about 1.0 mm and about 6.0 mm. In some embodiments, the thickness 117 may include a distance between about 2.0 mm and about 4.0 mm.

In some embodiments, as shown in FIGS. 2A and 2B, the container 110 may include a lip 128. The lip 128 may be configured to receive a portion of the lid 150 when the lid 150 is placed on the container 110, as further described below with reference to FIGS. 3A-3C. In some embodiments, the lip 128 may extend from the sidewall 112. In some embodiments, at least a portion of the top edge 112A of the sidewall 112 may be positioned a distance 129 from the lip 128. In some embodiments, the distance 129 may include a distance of about 0.1 mm, about 0.5 mm, about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, and/or any value between the aforementioned values. In some embodiments, the distance 129 may include a distance between about 2.0 mm and about 10.0 mm. In some embodiments, the distance 129 may include a distance between about 4.0 mm and about 8.0 mm. In some embodiments, the lip 128 may include the thickness 117. In some embodiments, the thickness 117 of the lip 128 may include a same thickness as the sidewall 112, the bottom 113, the front wall 114, and/or the angled wall 115. In some embodiments, the thickness 117 of the lip 128 may include a different thickness from at least one of the sidewall 112, the bottom 113, the front wall 114, and/or the angled wall 115.

Figure 3A:
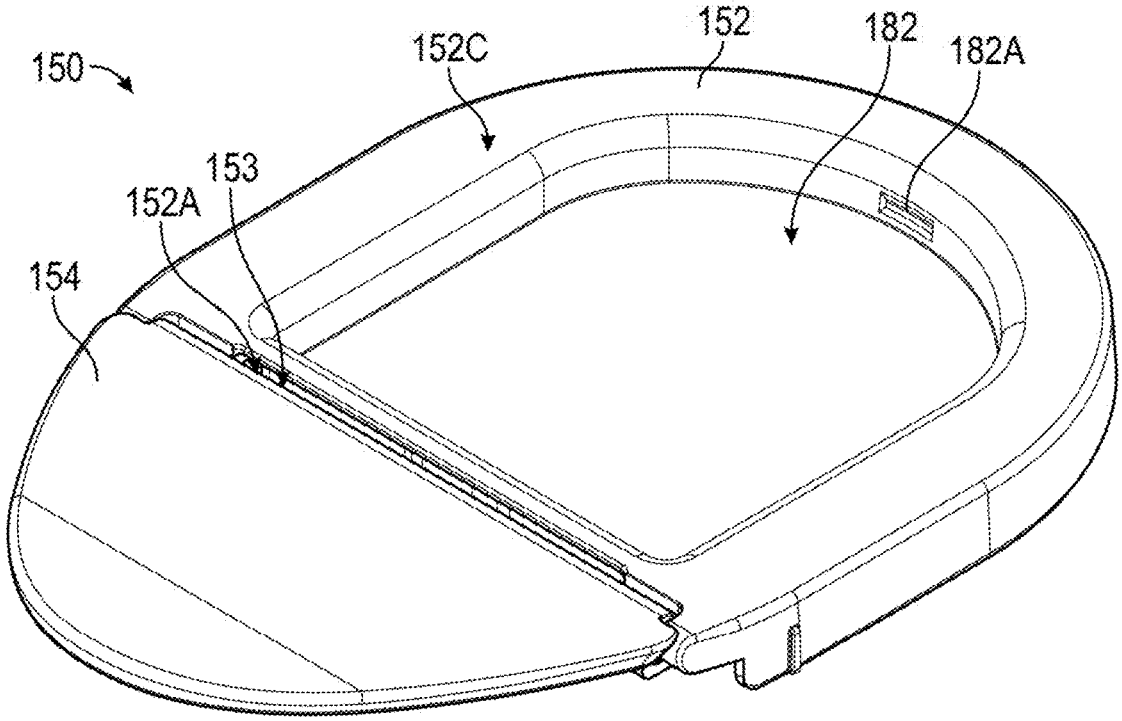
FIG. 3A illustrates a perspective view of a lid of the self-leveling container system of FIG. 1.
Figure 3B:
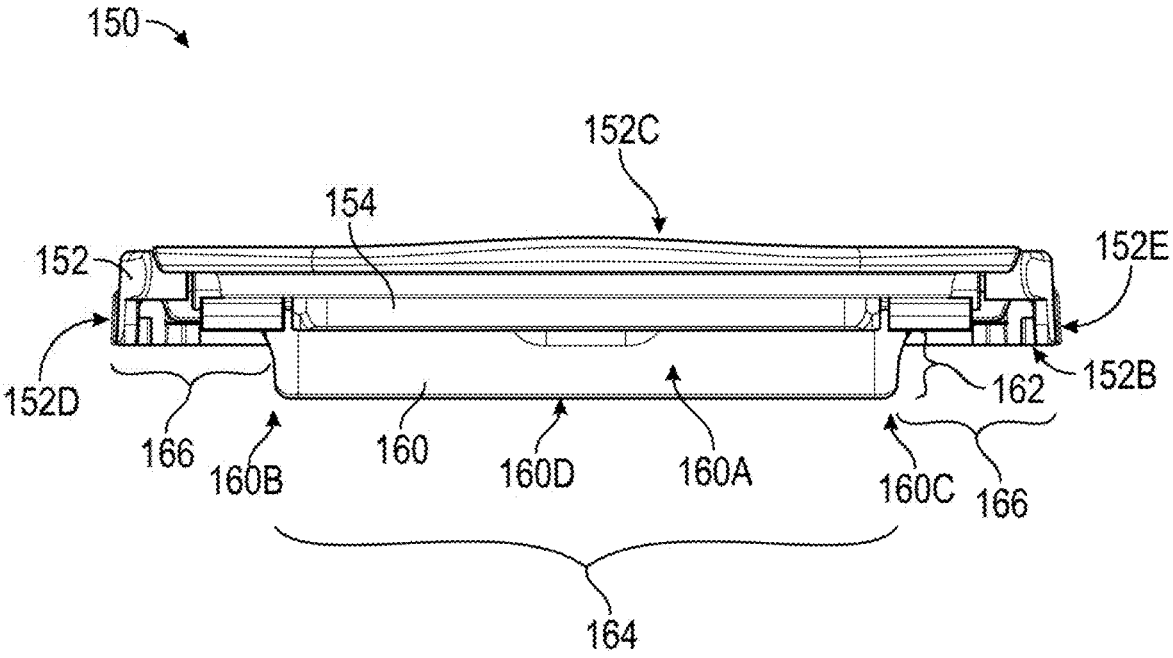
FIG. 3B illustrates a front view of the lid of FIG. 3A.
Figure 3C:
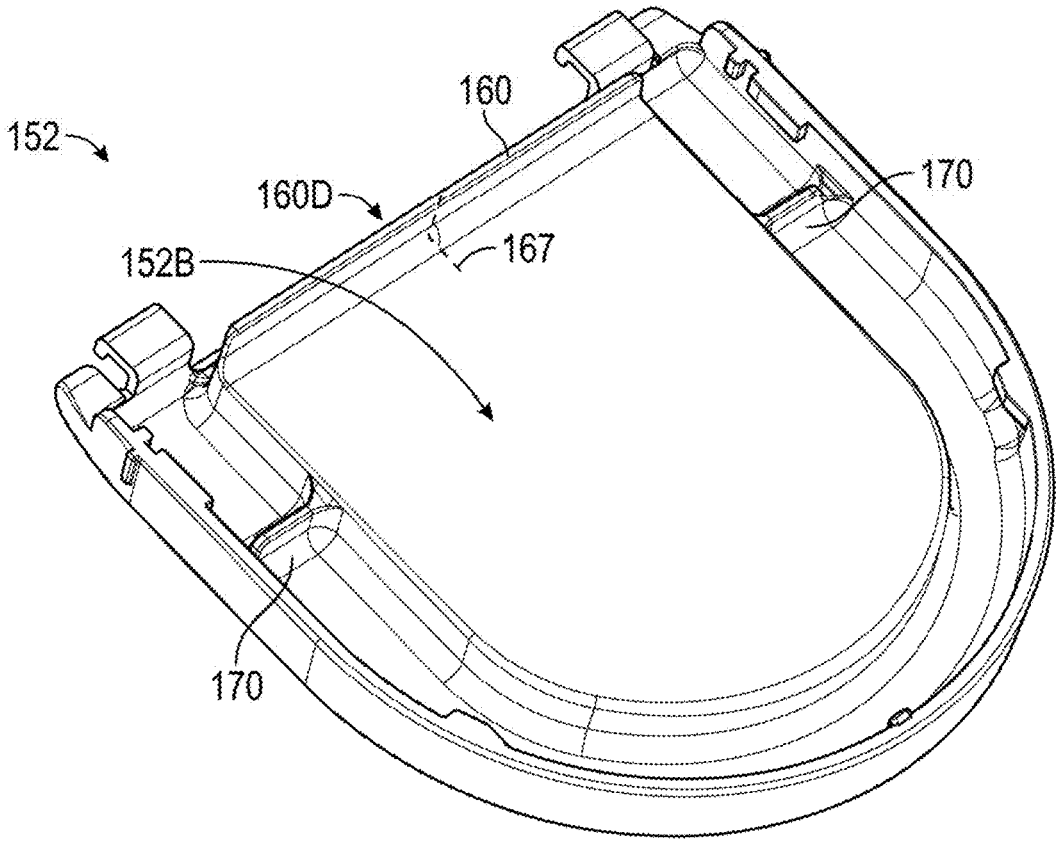
FIG. 3C illustrates a perspective view of a first portion of the lid of FIG. 3A.

FIGS. 3A-3C show the lid 150 of the self-leveling container system 100. The lid 150 may include a first portion 152 and a second portion 154. In some embodiments, the first portion 152 may include a portion of the lid 150 configured to cover the flat portion 118A of the opening 118. In some embodiments, the first portion 152 may include a same shape as the flat portion 118A of the opening 118 (i.e., the central portion 124A of the profile shape 124 and the first peripheral portion 124B of the profile shape 124). The first portion 152 may be coupled to the container 110, as shown in FIGS. 1 and 4A-5. In some embodiments, the first portion 152 may be removably coupled to the sidewall 112. The first portion 152 may be removably coupled to the top edge 112A of the sidewall 112. As shown in FIG. 3C, the first portion 152 may include a bottom 152B where the bottom 152B faces the recess 116 and/or the bottom 113 of the container 110 when the first portion 152 is coupled to the container 110. The first portion 152 may include a top 152C opposite the bottom 152B.

In some embodiments, the second portion 154 may include a portion of the lid 150 configured to cover the angled portion 118B of the opening 118. In some embodiments, the second portion 154 may include a same shape as the angled portion 118B of the opening 118 and/or a same shape as the angled wall 115.

The second portion 154 may be rotatably coupled to the first portion 152 so the second portion 154 may rotate relative to the first portion 152. In some embodiments, the second portion 154 may be rotatably coupled to a front edge 152A of the first portion 152. In some embodiments, the front edge 152A of the first portion 152 may be an edge of the first portion 152 positioned above the front edge 113A of the bottom 113 when the first portion 152 is coupled to the container 110. In some embodiments, the front edge 152A of the first portion 152 may be an edge of the first portion 152 positioned at a location along the length of the axis 127 where the front wall 114 is coupled to the sidewall 112. In some embodiments, the front edge 152A of the first portion 152 may be an edge of the first portion 152 positioned over or in the opening 118. In some embodiments, the front edge 152A of the first portion 152 may be an edge of the first portion 152 positioned at a location along the length of the axis 127 where the angled portion 118B of the opening 118 intersects the flat portion 118A of the opening 118.

Figure 4A:
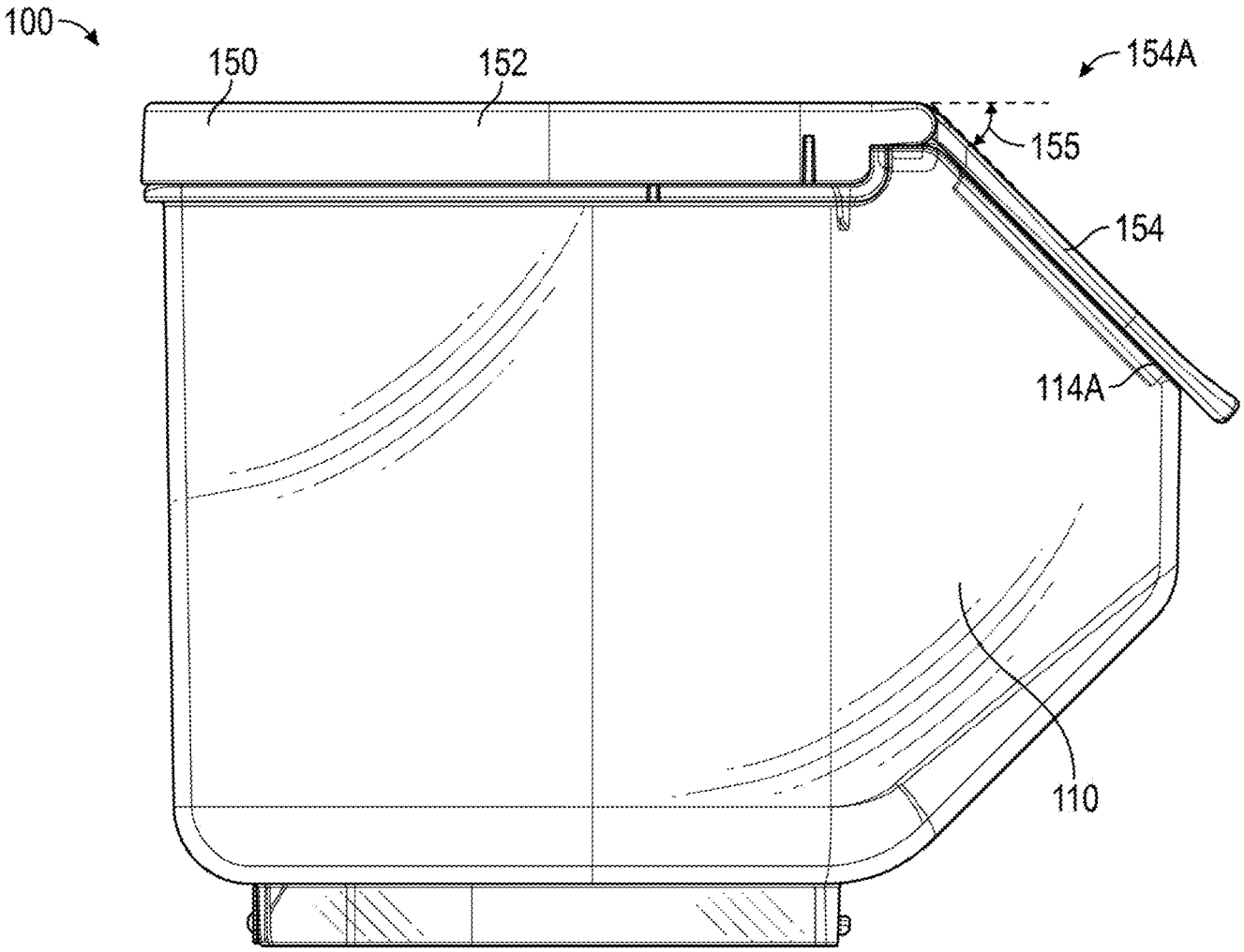
FIG. 4A illustrates the self-leveling container system of FIG. 1 with the lid in a closed position.
Figure 4B:
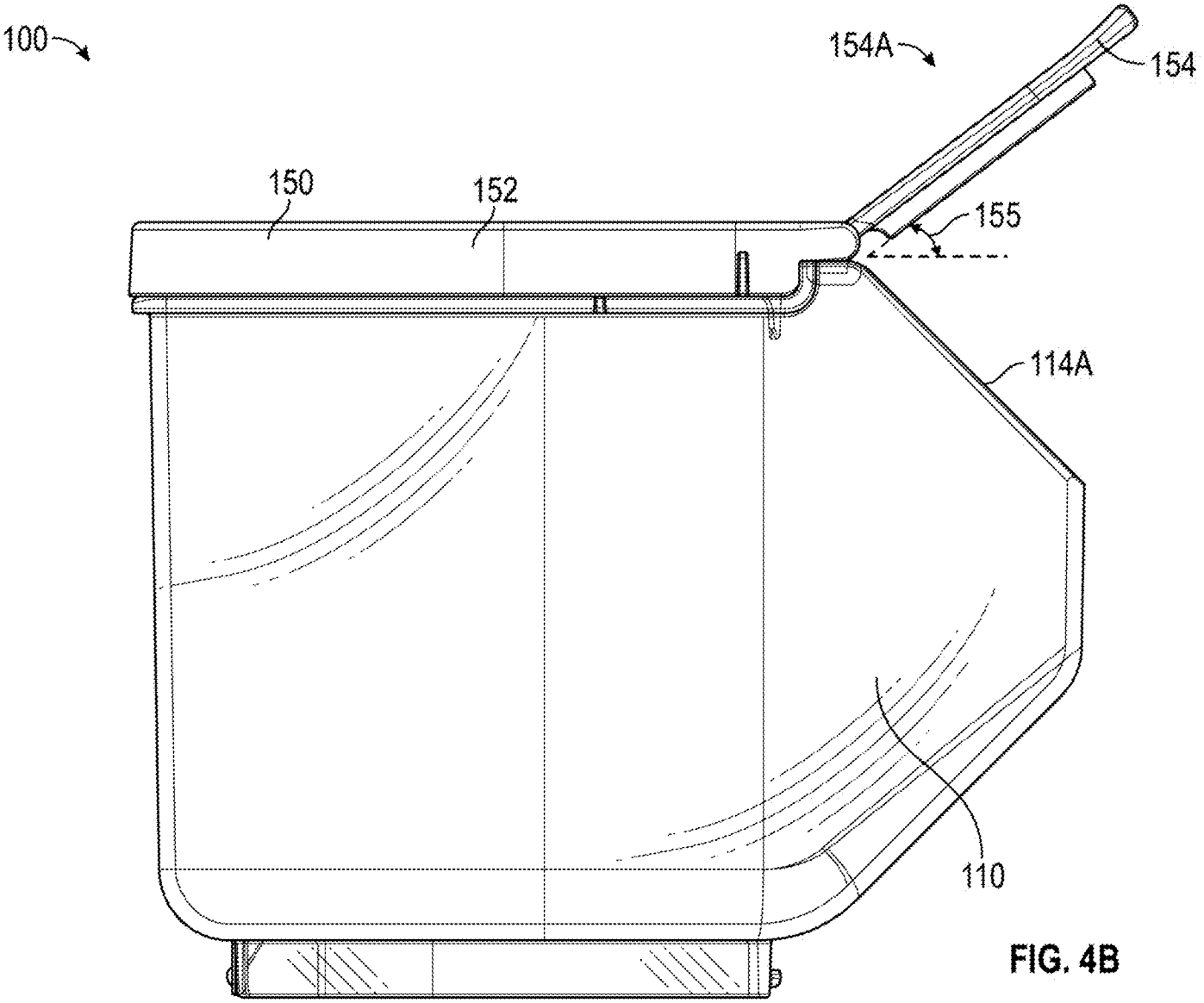
FIG. 4B illustrates the self-leveling container system of FIG. 1 with the lid in an open position.

As shown in FIGS. 4A and 4B, in some embodiments, the second portion 154 may include a closed position 154A (shown in FIG. 4A) and an open position 154B (shown in FIG. 4B). In some embodiments, when the lid 150 is coupled to the container 110 and the second portion 154 is in the closed position 154A, the second portion 154 may contact the top edge 114A of the front wall 114. In some embodiments, the second portion 154 may form an angle 155 with the first portion 152. In some embodiments, when the second portion 154 is in the closed position 154A, the angle 155 may be a same angle as the angle 120 and/or the angle 122. In some embodiments, when the second portion 154 is in the open position 154B, the angle 155 may include an angle of about 1 degree, about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 28 degrees, about 85 degrees, about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, about 180 degrees, and/or any value between the aforementioned values. In some embodiments, when the second portion 154 is in the open position 154B, the angle 155 may include an angle between about 45 degrees and about 175 degrees. In some embodiments, when the second portion 154 is in the open position 154B, the angle 155 may include an angle between about 90 degrees and about 175 degrees. In some embodiments, the second portion 154 may contact the top 152C of the first portion 152 when the second portion 154 is in the open position 154B.

As shown in FIG. 3A, in some embodiments, the lid 150 may include a gap 153 (i.e., a seam) between the first portion 152 and the second portion 154. In some embodiments, the gap 153 may be positioned or located between the front edge 152A of the first portion 152 and the second portion 154. In some embodiments, the gap 153 may inhibit (i.e., prevent) the second portion 154 from contacting the first portion 152. In some embodiments, the gap 153 may allow the second portion 154 to rotate relative to the first portion 152 without contacting the first portion 152. In some embodiments, the gap 153 may allow the second portion 154 to rotate between the closed position 154A and the open position 154B without contacting the first portion 152. In some embodiments, the gap 153 may inhibit (i.e., prevent) the first portion 152 from inhibiting (i.e., preventing) rotation of the second portion 154 relative to the first portion 152.

Figure 3D:
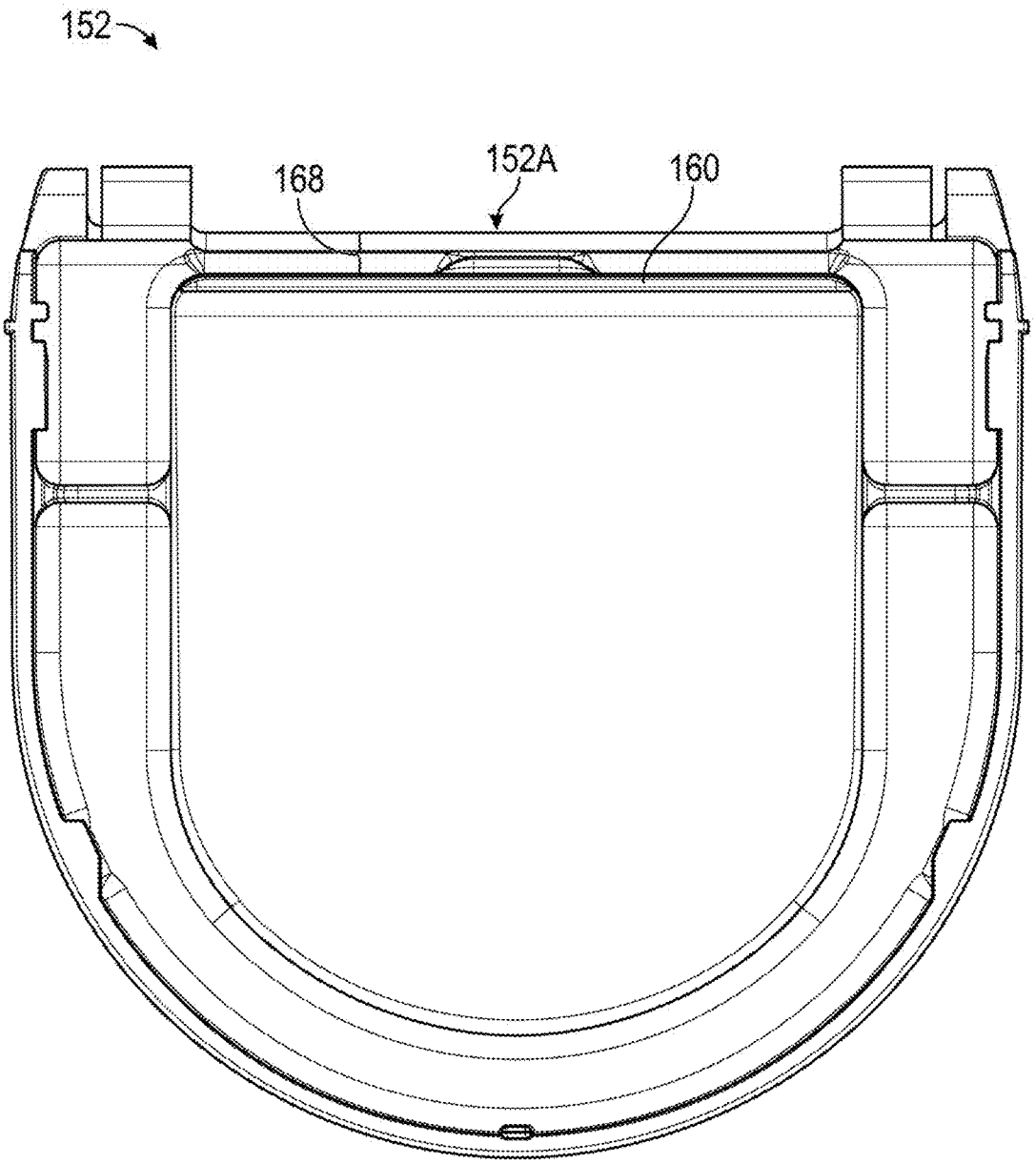
FIG. 3D illustrates a bottom view of the first portion of the lid of FIG. 3A.

As shown in FIGS. 3B-3D, in some embodiments, the first portion 152 may include a leveling mechanism 160. In some embodiments, the leveling mechanism may be coupled to the bottom 152B of the first portion 152. The leveling mechanism 160 may extend from a bottom 152B of the first portion 152 to a first end 160D of the leveling mechanism 160. The leveling mechanism 160 may include a profile shape 160A when viewed form a front view shown in FIG. 3B. The profile shape 160A may include a square, a rectangle, a semicircle, a semi ellipse, a trapezoid, a parabola, and/or any other shape. The leveling mechanism 160 may include a height 162 and a width 164. The height 162 of the leveling mechanism 160 may include a distance from the bottom 152B of the first portion 152 to the first end 160D of the leveling mechanism 160. In some embodiments, the height 162 of the leveling mechanism 160 may include a distance of about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, about 10.5 mm, about 11.0 mm, about 11.5 mm, about 12.0 mm, about 12.5 mm, about 13.0 mm, about 13.5 mm, about 14.0 mm, about 14.5 mm, about 15.0 mm, 15.5 mm, about 16.0 mm, about 16.5 mm, about 17.0 mm, about 17.5 mm, about 18.0 mm, about 18.5 mm, about 19.0 mm, about 19.5 mm, about 20.0 mm, and/or any value between the aforementioned values. In some embodiments, the height 162 of the leveling mechanism 160 may include a distance between about 2.0 mm and about 15.0 mm. In some embodiments, the height 162 of the leveling mechanism 160 may include a distance between about 6.0 mm and about 10.0 mm.

The width 164 of the leveling mechanism 160 may include a distance across the leveling mechanism 160 perpendicular to the height 162 when viewed from the front view shown in FIG. 3B. In some embodiments, the width 164 of the leveling mechanism 160 may include a distance between a left edge 160B of the leveling mechanism 160 a right edge 160C of the leveling mechanism, where left and right are designated as left and right when the lid 150 is viewed from the front view shown in FIG. 3B. In some embodiments, the width 164 of the leveling mechanism 160 may include a distance of about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, about 125 mm, about 130 mm, about 135 mm, about 140 mm, about 145 mm, about 150 mm, about 155 mm, about 160 mm, about 165 mm, about 170 mm, 175 mm, about 180 mm, about 185 mm, about 190 mm, about 195 mm, about 200 mm, and/or any value between the aforementioned values. In some embodiments, the width 164 of the leveling mechanism 160 may include a distance between about 40 mm and about 120 mm. In some embodiments, the width of the leveling mechanism 160 may include a distance between about 80 mm and about 100 mm.

In some embodiments, the left edge 160B of the leveling mechanism 160 may be a distance 166 from a left edge 152D of the first portion 152 of the lid 150 and the right edge 160C of the leveling mechanism 160 may be the distance 166 from a right edge 152E of the first portion 152 of the lid 150 where left and right are designated as left and right when the lid 150 is viewed from the front view shown in FIG. 3B. In some embodiments, the distance 166 may be a distance from the left edge 160B to the sidewall 112 of the container 110 when the lid 150 is coupled to the container 110 and/or the distance 166 from the right edge 160C to the sidewall 112 of the container 110 when the cover is coupled to the container 110. In some embodiments, the distance 166 may include a distance of about 5 mm, about 10 mm, about 15 mm, about 20 mm, about 25 mm, about 30 mm, about 35 mm, about 40 mm, about 45 mm, about 50 mm. and/or any value between the aforementioned values. In some embodiments, the distance 166 may be a distance between about 10 mm and about 40 mm. In some embodiments, the distance may be a distance between about 15 mm and about 25 mm.

In some embodiments, the leveling mechanism 160 may be coupled to the bottom of the first portion 152 a distance 168 from the front edge 152A of the first portion 152 as shown in FIG. 3D. In some embodiments, the distance 168 may include a distance from the gap 153 to the leveling mechanism 160. In some embodiments, the distance 168 may include a distance of about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, about 10.5 mm, about 11.0 mm, about 11.5 mm, about 12.0 mm, about 12.5 mm, about 13.0 mm, about 13.5 mm, about 14.0 mm, about 14.5 mm, about 15.0 mm, and/or any value between the aforementioned values. In some embodiments, the distance 168 may include a distance between about 2.0 mm and about 10.0 mm. In some embodiments, the distance 168 may include a distance between about 5.0 mm and about 7.0 mm.

In some embodiments, the leveling mechanism 160 may be coupled to the first portion 152 at an angle 167. In some embodiments, the angle 167 may include an angle of about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 28 degrees, about 85 degrees, about 90 degrees, and/or any value between the aforementioned values. In some embodiments, the angle 167 may be between about 45 degrees and about 90 degrees. In some embodiments, the angle 167 may be between about 80 degrees and about 90 degrees.

As shown in FIG. 3C, in some embodiments, the first portion 152 may include one or more extensions 170. The one or more extensions 170 may be coupled to the bottom 152B of the first portion 152. In some embodiments, the one or more extensions 170 may be coupled to the bottom 152B at the left edge 152D and/or the right edge 152E or adjacent to the left edge 152D and/or the right edge 152E. The one or more extensions 170 may contact an inner surface 112B of the sidewall 112, shown in FIG. 2A, where the inner surface 112B of the sidewall faces the recess 116. In some embodiments, the one or more extensions 170 may inhibit (i.e., prevent) the sidewall 112 from bending (i.e., flexing or deforming) so the lid 150 does not decoupled from the container 110.

Figure 5A:
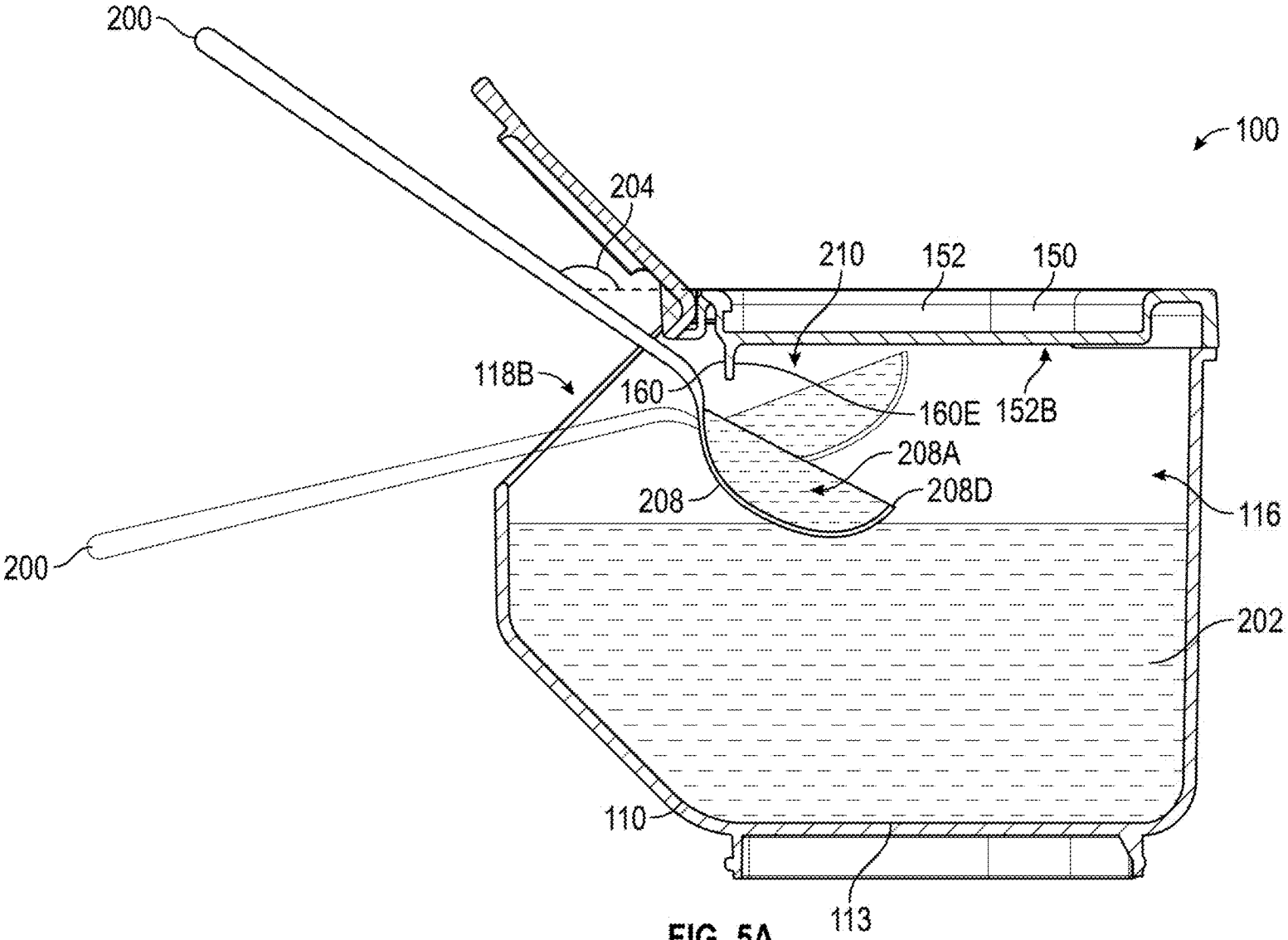
FIG. 5A illustrates a scoop removing one or more substances from the self-leveling container system of FIG. 1.
Figure 5B:
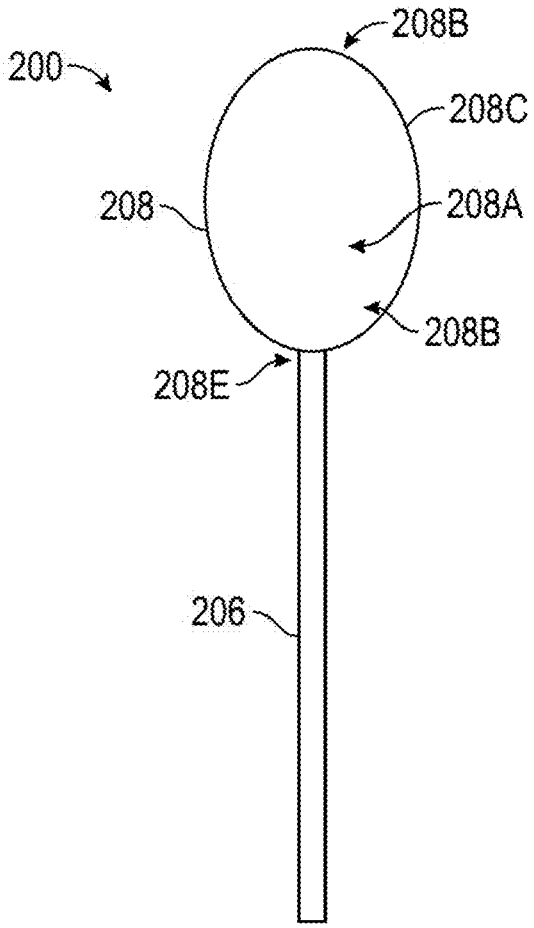
FIG. 5B illustrates a scoop for use with the self-leveling container system of FIG. 1.

FIG. 5A shows a scoop 200 removing the one or more substances 202 from the self-leveling container system 100. As shown in FIG. 5B, the scoop 200 may include a handle 206 and a bowl portion 208 coupled to the handle 206. In some embodiments, the bowl portion 208 may be configured to hold a volume of the one or more substances 202. The bowl portion 208 may include a recess 208A and an opening 208B where the recess is formed by a wall 208C of the bowl portion 208. In some embodiments, the opening 208B may be formed by an edge 208D of the wall 208C.

In some embodiments, the scoop 200 may be inserted into the recess 116 via the angled portion 118B of the opening 118. The scoop 200 may be inserted into and/or removed from the recess 116 at an angle 204 where the angle 204 is an angle between the scoop 200 and the first portion 152 of the lid 150. In some embodiments, the angle 204 may be an angle of about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, about 180 degrees, about 185 degrees, about 190 degrees, about 195 degrees, about 200 degrees, about 205 degrees, about 210 degrees, about 215 degrees, about 220 degrees, about 230 degrees, about 235 degrees, about 240 degrees, about 245 degrees, about 250 degrees and/or any value between the aforementioned values. In some embodiments, the angle 204 may be an angle between about 100 degrees and about 220 degrees. In some embodiments, the angle 204 may be an angle between about 120 degrees and about 200 degrees.

In some embodiments, the scoop 200 may be inserted into the recess 116 to fill the scoop 200 with the one or more substances 202 and remove the one or more substances 202 from the recess 116. In some embodiments, the scoop 200 may be sized and/or shaped so a predetermined volume of the one or more substances 202 is removed from the recess 116 via the scoop. After the scoop 200 is filled with the one or more substances 202, the scoop 200 may be removed from the recess 116. In some embodiments, when the scoop 200 is removed from the recess 116 the leveling mechanism 160 may contact the scoop 200 and/or the scoop 200 may contact the leveling mechanism 160. In some embodiments, when the scoop 200 is removed from the recess 116 the first end 160D of the leveling mechanism 160 may contact the scoop 200 and/or the scoop 200 may contact the first end 160D of the leveling mechanism 160. In some embodiments, the leveling mechanism 160 may be sized and/or shaped so the leveling mechanism 160 contacts the scoop 200 and/or the scoop 200 contacts the leveling mechanism regardless of an amount of the one or more substances 202 in the container 110.

In some embodiments, when the scoop 200 is filled with the one or more substances 202, the bowl portion 208 may contain more volume of the one or more substances 202 than the predetermined volume. In some embodiments, a portion of the one or more substances 202 may be positioned above the opening 208B (i.e., outside of or not in the recess 208A). When the leveling mechanism 160 contacts the scoop 200, the leveling mechanism 160 may contact the edge 208D of the wall 208C. In some embodiments, the leveling mechanism 160 may contact a first end 208E of the bowl portion 208 located where the bowl portion 208 is coupled to the handle 206.

As the scoop 200 is removed from the recess 116, the leveling mechanism 160 may move relative to the bowl portion 208 from the first end 208E of the bowl portion 208 to a second end 208F of the bowl portion 208 opposite the first end 208E. In some embodiments, the leveling mechanism 160 may remove excess of the one or more substances 202 from the bowl portion 208. The excess of the one or more substances 202 may include the portion of the one or more substances position above the opening 208B of the bowl portion. The leveling mechanism 160 may push the portion of the one or more substances 202 positioned above the opening 208B off of the bowl portion 208. The leveling mechanism 160 may level the one or more substances 202 by partially or completely removing the portion of the one or more substances 202 positioned above the opening 208B from the bowl portion 208. In some embodiments, after the leveling mechanism pushes the portion of the one or more substances 202 positioned above the opening 208B off of the bowl portion 208 a volume of the one or more substances 202 in the bowl portion 208 may be the predetermined volume.

In some embodiments, the leveling mechanism 160 may push the portion of the one or more substances 202 positioned above the opening 208B to a holding zone 210. In some embodiments, the holding zone 210 may include a volume between a surface 160E, as shown in FIG. 3C, and the bottom 152B of the first portion 152 of the lid 150. A portion of the one or more substances 202 may be remain in the holding zone 210 when the bowl portion 208 is between the portion of the one or more substances 202 in the holding zone 210 and the bottom 113 of the container 110. In some embodiments, the portion of the one or more substances 202 may move (i.e., fall) out of the holding zone 210 when the bowl portion 208 is not between the portion of the one or more substances 202 in the holding zone 210 and the bottom 113 of the container 110. In this way the one or more substances 202 pushed off the bowl portion 208 and/or into the holding zone 210 may remain in the recess 116 when the scoop 200 is removed from the recess 116.

In some embodiments, as described above with reference to FIG. 3D, the leveling mechanism 160 may be coupled to the bottom 152B of the first portion 152 of the lid 150 the distance 168 from the front edge 152A of the first portion 152. In some embodiments, the leveling mechanism 160 may be positioned the distance 168 from the front edge 152A of the first portion 152. In some embodiments, the leveling mechanism 160 may inhibit (i.e., prevent) the one or more substances 202 from leaving the container 110 via the gap 153. In some embodiments, the leveling mechanism may be positioned the distance 168 from the front edge 152A of the first portion 152 to inhibit (i.e., prevent) the one or more substances 202 from leaving the container 110 via the gap 153.

In some embodiments, the leveling mechanism 160 may contact the scoop 200 when the scoop 200 is removed from the recess 116 regardless of the angle 204 that the scoop 200 forms with the first portion 152 of the lid 150 when the scoop is removed from the recess 116. In some embodiments, the leveling mechanism 160 may contact the scoop 200 without requiring a user to move the scoop 200 in a particular motion or at a particular angle 204. In some embodiments, as shown in FIG. 5A, the angled portion 118B of the opening 118 may extend below the first end 160D of the leveling mechanism 160. In some embodiments, the leveling mechanism 160 may contact the scoop 200 without requiring the user to move the scoop 200 in a particular motion or at a particular angle 204 since the angled portion 118B of the opening 118 extends below the first end 160D of the leveling mechanism 160. In some embodiments, at least a portion of the top edge 114A of the front wall 114 may be positioned below the first end 160D of the leveling mechanism 160. In some embodiments, the leveling mechanism 160 may contact the scoop 200 without requiring the user to move the scoop 200 in a particular motion or at a particular angle 204 since at least the portion of the top edge 114A of the front wall 114 is positioned below the first end 160D of the leveling mechanism 160.

As shown in FIG. 2B, in some embodiments, the bottom 113 of the container 110 may include a stand 180. The stand 180 may extend from the bottom 113 of the container 110. In some embodiments, when the container 110 is placed on a surface, the stand 180 may contact the surface. In some embodiments, the stand 180 may include a same shape as a shape of the central portion 124A and the first peripheral portion 124B of the profile shape 124. In some embodiments, the stand 180 may be smaller than the central portion 124A and the first peripheral portion 124B of the profile shape 124. In some embodiments, the stand 180 may include one or more engagement features 180A. As shown in FIG. 3A, the first portion 152 of the lid 150 may include a recess 182. In some embodiments, the recess 182 may include a same shape as a shape of the stand 180. In some embodiments, the recess 182A may include one or more engagement features.

Figure 6:
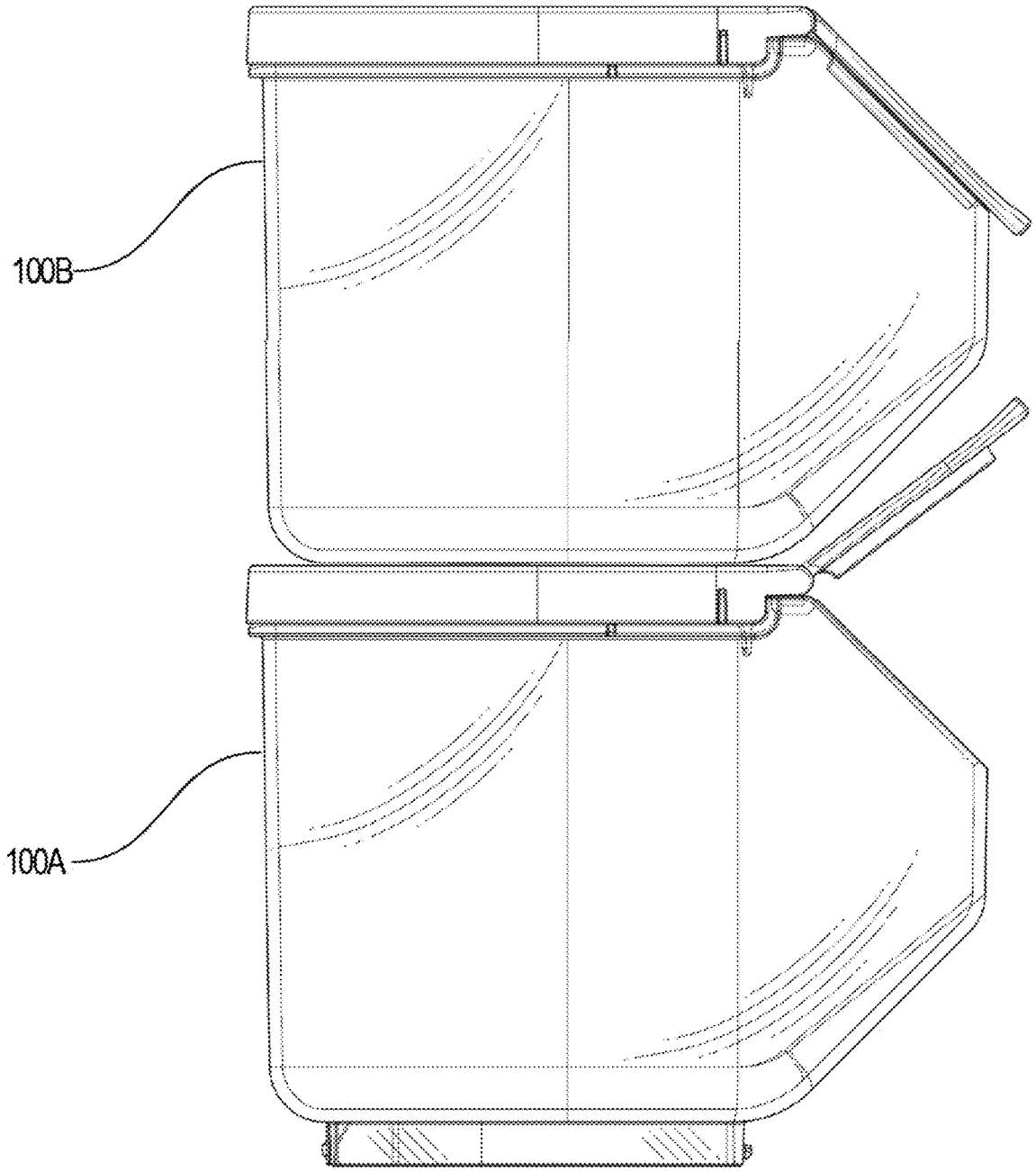
FIG. 6 illustrates a first self-leveling container system with a second self-leveling container system stack on top of the first self-leveling container system.

FIG. 6 shows a first self-leveling container system 100A and a second self-leveling container system 100B, wherein the second self-leveling container system 100B is stacked on top of the first self-leveling container system 100A. In some embodiments, the recess 182 of the first self-leveling container system 100A may be configured to receive the stand 180 of the second self-leveling container system 100B. In some embodiments, the stand 180 of the second self-leveling container system 100B may be inserted into the recess 182 of the first self-leveling container system 100A to stack the second self-leveling container system 100B on top of the first-self leveling container system 100A.

In some embodiments, the one or more engagement features 182A of the recess 182 of the first self-leveling system 100A may be configured to engage the one or more engagement features 180A of stand 180 of the second self-leveling container system 100B to interlock or secure the second self-leveling container system 100B to the first self-leveling system 100A. In some embodiments, the one or more engagement features 182A of the recess 182 and the one or more engagement features 180A of stand 180 may reduce or eliminate a need for a rack, a fixture, and/or any other securement mechanisms for the first self-leveling system 600A and/or the second self-leveling system 100A.

In some embodiments, the user may remove the one or more substances 202 from the first self-leveling container system 100A and/or the second self-leveling container 100B system when the second self-leveling container system 100B is stacked on top of the first-self leveling container system 100A. In some embodiments, as described further above, the second portion 154 may be configured to cover the angled portion 118B of the opening 118, and the angled portion 118B may extend below the top edge 112A which may allow the user to access the recess 116 of the first self-leveling container system 100A when the second self-leveling container system 100B is stacked on top of the first-self leveling system 100A. In some embodiments, the angled wall 115 of the second self-leveling container 100B may allow the second portion 154 of the lid 150 of the first self-leveling container system 100A to rotate between the closed position 154A and the open position 154B when the second self-leveling container system 100B is stacked on top of the first-self leveling system 100A.

Certain Terminology

As used herein, the term "beverage" has its ordinary and customary meaning, and includes, among other things, any edible liquid or substantially liquid substance or product having a flowing quality (e.g., juices, coffee beverages, teas, milk, beer, wine, cocktails, liqueurs, spirits, cider, soft drinks, flavored water, energy drinks, soups, broths, combinations of the same, or the like).

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. Numbers preceded by a term such as "about" or "approximately" include the recited numbers and should be interpreted based on the circumstances (e.g., as accurate as reasonably possible under the circumstances, for example. For example, "about 1 gram" includes "1 gram." In the embodiments described in this application, terms such as "about" or "approximately" within the specification or claims that precede values or ranges can be omitted such that this application specifically includes embodiments of the recited values or ranges with the terms "about" or "approximately" omitted from such values and ranges such that they can also be claimed without the terms "about" or "approximately" before the disclosed range. The term "generally" as used herein represents a value, amount, or characteristic that predominantly includes, or tends toward, a particular value, amount, or characteristic. As an example, in certain embodiments, as the context may dictate, the term "generally parallel" can refer to something that departs from exactly parallel by less than or equal to 20 degrees and/or the term "generally perpendicular" can refer to something that departs from exactly perpendicular by less than or equal to 20 degrees.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

The following example embodiments identify some possible permutations of combinations of features disclosed herein, although other permutations of combinations of features are also possible.

SUMMARY

Although certain aspects, advantages, and features are described herein, it is not necessary that any particular embodiment include or achieve any or all of those aspects, advantages, and features. For example, some embodiments may not achieve the advantages described herein, but may achieve other advantages instead. Any structure, feature, or step in any embodiment can be used in place of, or in addition to, any structure, feature, or step in any other embodiment, or omitted. This disclosure contemplates all combinations of features from the various disclosed embodiments. No feature, structure, or step is essential or indispensable. In addition, although this disclosure describes certain embodiments and examples of beverage systems and methods, many aspects of the above-described systems and methods may be combined differently and/or modified to form still further embodiments or acceptable examples. All such modifications and variations are intended to be included herein within the scope of this disclosure.

Also, although there may be some embodiments within the scope of this disclosure that are not expressly recited above or elsewhere herein, this disclosure contemplates and includes all embodiments within the scope of what this disclosure shows and describes. Further, this disclosure contemplates and includes embodiments comprising any combination of any structure, material, step, or other feature disclosed anywhere herein with any other structure, material, step, or other feature disclosed anywhere herein.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Some embodiments have been described in connection with the accompanying drawings. The figures are drawn to scale, but such scale should not be interpreted to be limiting. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Also, any methods described herein may be practiced using any device suitable for performing the recited steps.

Moreover, while components and operations may be depicted in the drawings or described in the specification in a particular arrangement or order, such components and operations need not be arranged and performed in the particular arrangement and order shown, nor in sequential order, nor include all of the components and operations, to achieve desirable results. Other components and operations that are not depicted or described can be incorporated in the embodiments and examples. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products.

In summary, various illustrative embodiments and examples of preparing edible extracts and methods have been disclosed. Although the systems and methods have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents

What is claimed is:

1. A self-leveling container system comprising:

a container configured to contain one or more substances, the container comprising:

a bottom;

a sidewall coupled to the bottom, the sidewall comprising a first edge;

a front wall coupled to the sidewall, the front wall comprising a second edge, wherein the second edge forms a first angle with the first edge;

a recess, wherein the recess is formed by the bottom, the sidewall and the front wall; and an opening to the recess, the opening comprising a flat portion formed by the first edge, and an angled portion formed by the second edge, wherein the angled portion is positioned at a second angle relative to the flat portion, wherein the second angle is a same angle as the first angle;

a lid comprising:

a first portion comprising a leveling mechanism coupled to the first portion a distance from a front edge of the first portion;

a second portion rotatably coupled to the front edge of the first portion, wherein when the first portion of the lid is coupled to the container, the first portion of the lid is configured to cover the flat portion of the opening, and the second portion is configured to cover the angled portion of the opening, wherein the angled portion of the opening extends below the leveling mechanism, and wherein the leveling mechanism is configured to contact a scoop to remove excess of the one or more substances in the scoop when the scoop is removed from the recess.

2. The system of claim 1, wherein the lid further comprises a gap between the front edge of the first portion and the second portion.

3. The system of claim 2, wherein the leveling mechanism inhibits the one or more substances from leaving the container via the gap when the leveling mechanism contacts the scoop.

4. The system of claim 1, wherein the distance is between about 2 mm and about 10 mm.

5. The system of claim 1, wherein the leveling mechanism comprises a height between about 2 mm and about 15 mm.

6. The system of claim 1, wherein the leveling mechanism comprises a width between about 40 mm and about 120 mm.

7. The system of claim 1, wherein the container comprises an angled wall coupled to the bottom of the container and a bottom edge of the front wall of the container, wherein the bottom edge is opposite the second edge.

8. The system of claim 7, wherein the angled wall forms a third angle with the bottom of the container.

9. The system of claim 8, wherein the third angle is a same angle as the first angle.

10. The system of claim 1, wherein the lid comprises a closed position and an open position, and wherein the second portion is configured to rotate between the closed position and the open position.

11. The system of claim 10, wherein the second portion contacts the second edge when lid is in the closed position.

12. The system of claim 1, wherein a portion of the second edge of the front wall is positioned below the leveling mechanism.

13. The system of claim 12, wherein when the scoop is removed from the container, the scoop forms an angle with the first portion of the lid, and wherein the leveling mechanism is configured to contact the scoop when the scoop is removed from the container at any angle.

14. The system of claim 1, wherein the bottom of the container comprises a stand, and the lid comprises a recess.

15. A self-leveling container system comprising:

a container configured to contain one or more substances, the container comprising:

a bottom;

a sidewall coupled to the bottom, the sidewall comprising a first edge;

a front wall coupled to the sidewall, the front wall comprising a second edge, wherein the second edge forms a first angle with the first edge;

a recess, wherein the recess is formed by the bottom, the sidewall and the front wall; and an opening to the recess, the opening comprising a flat portion formed by the first edge, and an angled portion formed by the second edge, wherein the angled portion is positioned at a second angle relative to the flat portion, wherein the first angle is a same angle as the second angle, and wherein the first angle and the second angle are an angle between about 30 degrees and about 60 degrees;

a lid comprising:

a first portion comprising a leveling mechanism coupled to the first portion a distance from a front edge of the first portion;

a second portion rotatably coupled to the front edge of the first portion, wherein when the first portion of the lid is coupled to the container, the first portion of the lid is configured to cover the flat portion of the opening, and the second portion is configured to cover the angled portion of the opening, and wherein the leveling mechanism is configured to contact a scoop to remove excess of the one or more substances in the scoop when the scoop is removed from the recess.

16. A self-leveling container system comprising:

a first container configured to contain one or more substances, the first container comprising:

a bottom;

a sidewall coupled to the bottom, the sidewall comprising a first edge;

a front wall coupled to the sidewall, the front wall comprising a second edge, wherein the second edge forms a first angle with the first edge;

a recess, wherein the recess is formed by the bottom, the sidewall and the front wall; and an opening to the recess, the opening comprising a flat portion formed by the first edge, and an angled portion formed by the second edge, wherein the angled portion is positioned at a second angle relative to the flat portion, a first lid comprising:

a first portion comprising a leveling mechanism coupled to the first portion a distance from a front edge of the first portion;

a second portion rotatably coupled to the front edge of the first portion, wherein when the first portion of the first lid is coupled to the first container, the first portion of the first lid is configured to cover the flat portion of the opening, and the second portion is configured to cover the angled portion of the opening, and wherein the leveling mechanism is configured to contact a scoop to remove excess of the one or more substances in the scoop when the scoop is removed from the recess, a second container and a second lid, and wherein the recess of the first lid is configured to receive a stand of the second container to secure the second container to the first lid so the second container is stacked on top of the first lid and the first container.

17. A lid for a self-leveling container system, the lid comprising:

a first portion comprising a leveling mechanism coupled to the first portion a distance from a front edge of the first portion;

a second portion rotatably coupled to the front edge of the first portion, wherein the leveling mechanism is configured to contact a scoop to remove excess substance in the scoop when the scoop is removed from a container, wherein the second portion is configured to rotate between a closed position and an open position, and the second portion extends downward from the front edge of the first portion at an angle with the first portion when the second portion is in the closed position.

18. The lid of claim 17, wherein the lid further comprises a gap between the front edge of the first portion and the second portion.

19. The lid of claim 18, wherein the leveling mechanism inhibits the excess substance from leaving the container via the gap when the leveling mechanism contacts the scoop.

20. The lid of claim 17, wherein the distance is between about 2 mm and about 10 mm.

21. The lid of claim 17, wherein the leveling mechanism comprises a height between about 2 mm and about 15 mm.

22. The lid of claim 17, wherein the leveling mechanism comprises a width between about 40 mm and about 120 mm.

23. The lid of claim 17, wherein the leveling mechanism is coupled to the first portion at an angle between about 45 degrees and about 90 degrees.

24. The lid of claim 17, wherein in the closed position, the second portion of the lid covers an angled portion of an opening of the container that extends below the leveling mechanism.

25. The lid of claim 17, wherein the first portion of the lid comprises a recess configured to receive a stand of a second container.

* * * * *